US009713911B2

(12) United States Patent
Cavazza et al.

(10) Patent No.: US 9,713,911 B2
(45) Date of Patent: Jul. 25, 2017

(54) PACKING UNIT AND METHOD FOR FOLDING A BLANK ON A PACKING MACHINE

(71) Applicant: G.D SOCIETA' PER AZIONI, Bologna (IT)

(72) Inventors: Luca Cavazza, Bologna (IT); Andrea Biondi, Bologna (IT); Umberto Zanetti, Modena (IT)

(73) Assignee: G.C. SOCIETA PER AZIONI, Bologna (IT)

( * ) Notice: Subject to any disclaimer, the term of this patent is extended or adjusted under 35 U.S.C. 154(b) by 487 days.

(21) Appl. No.: 14/337,463

(22) Filed: Jul. 22, 2014

(65) Prior Publication Data

US 2015/0031519 A1 Jan. 29, 2015

(30) Foreign Application Priority Data

Jul. 23, 2013 (IT) ..... BO2013A0387

(51) Int. Cl.
*B31F 1/30* (2006.01)
*B31B 1/58* (2006.01)
(Continued)

(52) U.S. Cl.
CPC ..... *B31B 1/58* (2013.01); *B31B 1/12* (2013.01); *B65B 5/024* (2013.01); *B65B 11/004* (2013.01);
(Continued)

(58) Field of Classification Search
CPC ..... B31B 1/58; B31B 1/12; B31B 2201/0241; B31B 2201/027; B31B 2201/267; B31B 2201/2683; B65B 5/024; B65B 11/004; B65B 11/18; B65B 43/185; B65B 43/265; B65B 59/005; B65B 43/52
(Continued)

(56) References Cited

U.S. PATENT DOCUMENTS 4,429,864 A * 2/1984 Scarpa ..... B65H 3/28 221/225
4,569,182 A * 2/1986 Leuvering ..... B65B 5/024 53/207
(Continued)

FOREIGN PATENT DOCUMENTS

JP 2004-299708 A 10/2004

OTHER PUBLICATIONS

Computer translation and Patent Abstract of Japan 2004-299708 A.

*Primary Examiner* — Sameh Tawfik
(74) *Attorney, Agent, or Firm* — Ladas & Parry LLP

(57) ABSTRACT

A packing unit and method for folding a blank on a packing machine; the packing unit having: a packing conveyor having at least one pocket for receiving the blank; and a feed device for inserting the blank into the pocket on the packing conveyor; the packing conveyor has at least a first conveyor belt defining a bottom wall, of the pocket; at least a second conveyor belt separate from, parallel to, and alongside the first conveyor belt, and defining the bottom wall of the pocket together with the first conveyor belt; a first retaining member, which projects perpendicularly from the first conveyor belt and defines a front wall of the pocket; and a second retaining member, which projects perpendicularly from the second conveyor belt and defines a rear wall of the pocket.

10 Claims, 13 Drawing Sheets

(51) Int. Cl.

| | |
|---|---|
| ***B31B 1/12*** | (2006.01) |
| ***B65B 43/26*** | (2006.01) |
| ***B65B 59/00*** | (2006.01) |
| ***B65B 43/18*** | (2006.01) |
| ***B65B 5/02*** | (2006.01) |
| ***B65B 11/00*** | (2006.01) |
| ***B65B 11/18*** | (2006.01) |
| *B65B 43/52* | (2006.01) |

(52) U.S. Cl.
CPC ..... *B65B 11/18* (2013.01); *B65B 43/185* (2013.01); *B65B 43/265* (2013.01); *B65B 59/005* (2013.01); *B31B 2201/027* (2013.01); *B31B 2201/0241* (2013.01); *B31B 2201/267* (2013.01); *B31B 2201/2683* (2013.01); *B31B 2201/286* (2013.01); *B31B 2201/289* (2013.01); *B65B 43/52* (2013.01)

(58) Field of Classification Search
USPC ..... 493/441, 309
See application file for complete search history.

(56) References Cited

U.S. PATENT DOCUMENTS

| | | | | |
|---|---|---|---|---|
| 4,571,236 | A * | 2/1986 | Adams | B31B 1/00 198/470.1 |
| 5,473,868 | A * | 12/1995 | Antonio | B65B 43/345 493/309 |
| 5,531,661 | A * | 7/1996 | Moncrief | B65B 43/265 493/313 |
| 5,711,137 | A | 1/1998 | Moncrief et al. | |
| 5,928,123 | A * | 7/1999 | Davis, Jr. | B31B 1/00 493/313 |
| 5,937,620 | A | 8/1999 | Chalendar | |
| 8,986,183 | B2 * | 3/2015 | Monti | B65B 43/185 493/162 |

* cited by examiner

19

4
34
22
4
13
4
33
12
18
11
21
25
23
20
47
16
24
49

19

4
13
12
11
4
34
22
13
11
4
33
21
25
26
23
20
47
16
24
49
17

PACKING UNIT AND METHOD FOR FOLDING A BLANK ON A PACKING MACHINE

TECHNICAL FIELD

The present invention relates to a packing unit and method for folding a blank on a packing machine.

The present invention may be used to advantage to fold a blank on a so-called 'boxing' machine, i.e. a packing machine for packing loose packages in a cardboard box, to which the following description refers purely by way of example.

BACKGROUND ART

Known boxing machines comprise an initial grouping unit where a number of lines of successive adjacent individual packages are formed; and a final grouping unit where a number of lines of packages are superimposed to form groups of packages. Downstream from the final grouping unit, a packing unit packs each group of packages into a respective cardboard box.

The packing unit comprises a blank store containing a stack of flat blanks; a packing belt conveyor with a succession of pockets; and a feed device which withdraws the first blank in the stack by suction and inserts it into a pocket on the packing conveyor; as it is inserted into the pocket on the packing conveyor, the blank is folded onto a 'U'. Next, a group of packages is inserted longitudinally into a packing conveyor pocket containing a U-folded blank, and the blank is gummed (i.e. glued) and folded further about the group of packages to form a cardboard box.

A unit of the above type described in document JP2004299708 comprises a packing conveyor with two pairs of side by side conveyor belts. So the blank is conveyed along the packing path inside pockets defined by the gaps between spacers on the conveyor belts. More specifically, the pockets are adjustable to adapt the seats to the content being conveyed.

Known packing units of the above type work well, but have the major drawback of not being very flexible. The flexibility of the conveying part does not match up with that of the packing unit as a whole, especially as regards feeding the blanks and unloading the finished containers. That is, chancing the blank format (i.e. size) involves changing several component parts on the packing unit. This is a particularly painstaking, time-consuming job requiring skilled labour, in that, in addition to removing parts and assembling new ones, the packing unit as a whole must be set up to make sure the new parts interact properly with the rest of the unit. This lack of flexibility is an increasingly important issue in view of the general market tendency towards small production lots with frequent changeovers.

DESCRIPTION OF THE INVENTION

It is an object of the present invention to provide a packing unit and method for folding a blank on a packing machine, designed to eliminate the above drawbacks (i.e. which are highly flexible) and which at the same time are cheap and easy to implement.

According to the present invention, there are provided a packing unit and method for folding a blank on a packing machine, as claimed, in the accompanying claims.

BRIEF DESCRIPTION OF THE DRAWINGS

A non-limiting embodiment of the present invention will be described by way of example with reference to the attached drawings, in which.

PREFERRED EMBODIMENTS OF THE INVENTION

Figure 1:
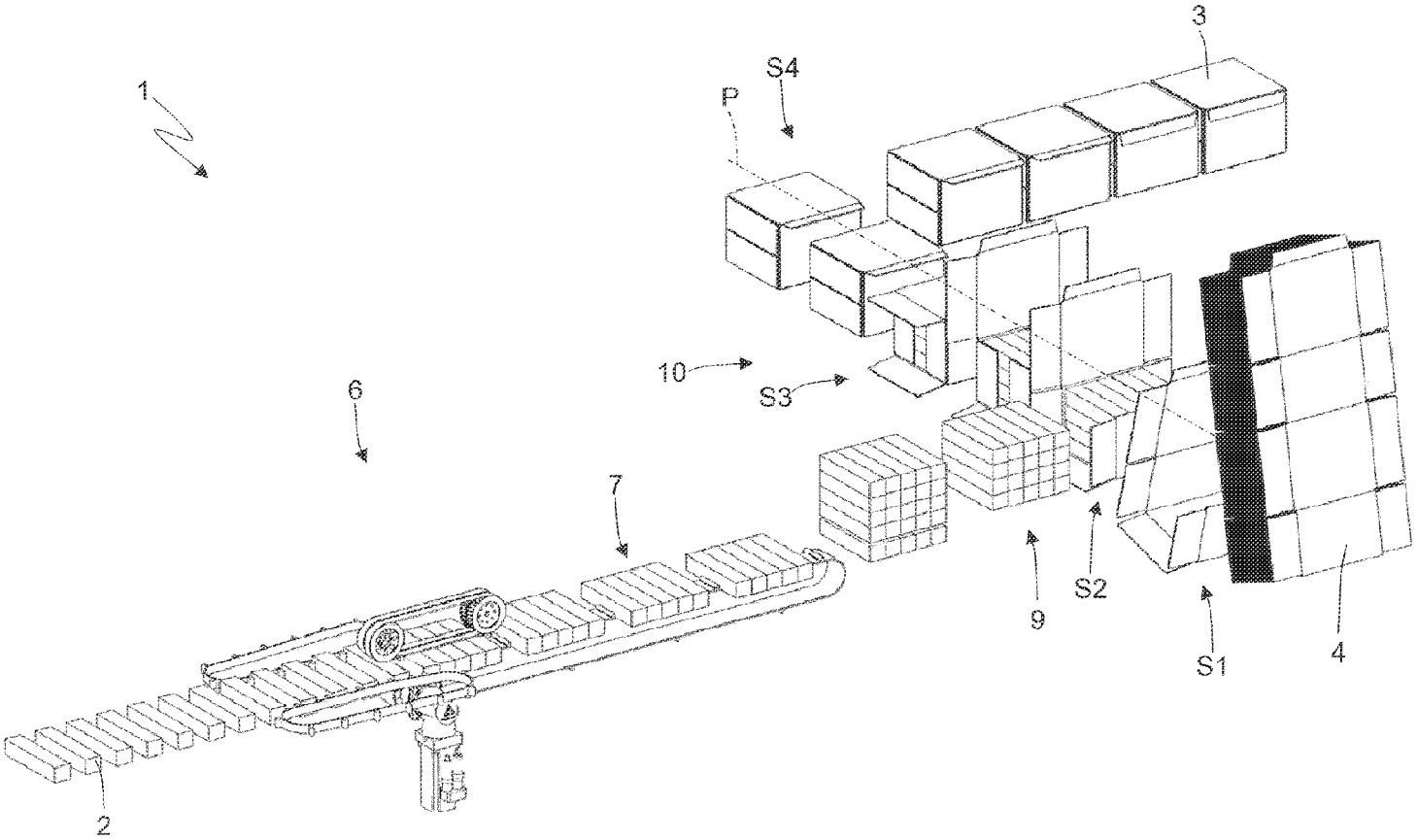
FIG. 1 shows a schematic view in perspective of a packing machine for packing loose packages in a cardboard box.
Figure 2:
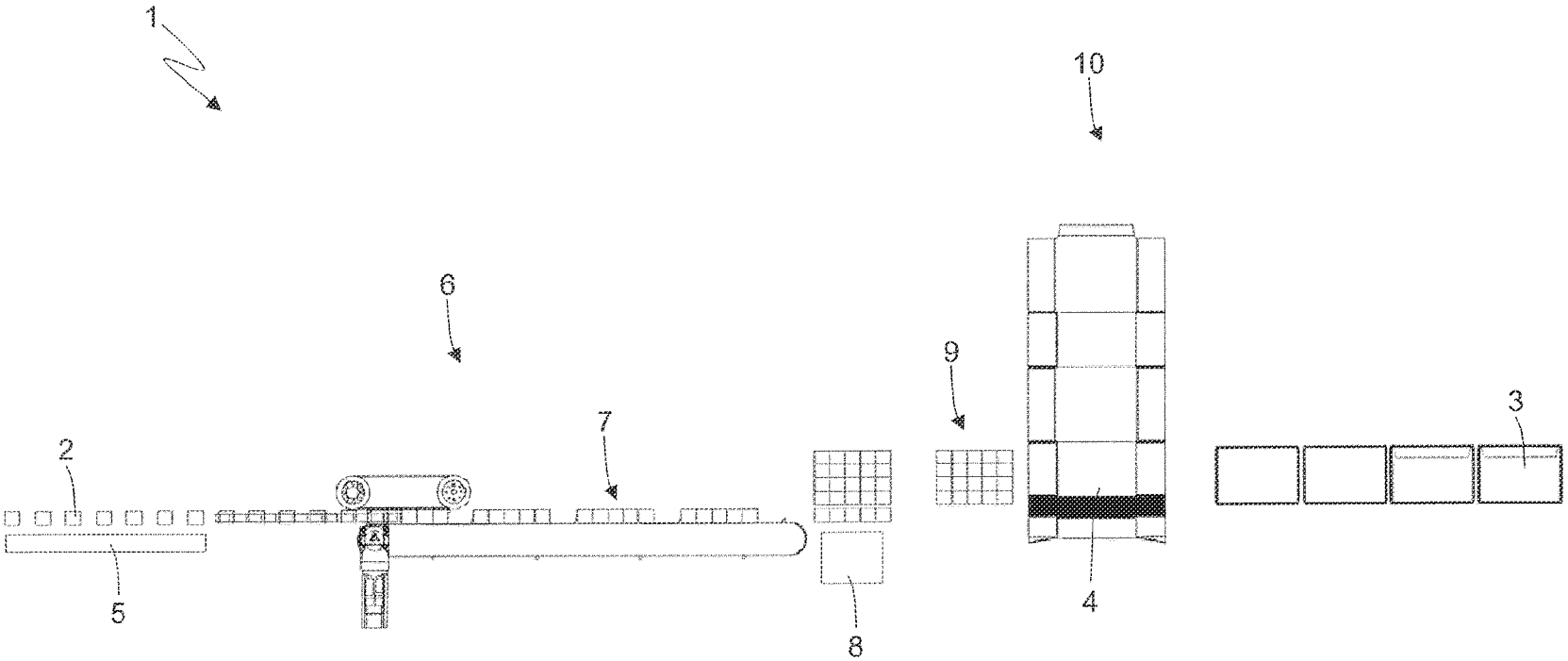
FIG. 2 shows a front view of the FIG. 1 packing machine.

Number 1 in FIGS. 1 and 2 indicates as a whole a packing (i.e. boxing) machine for packing loose packages 2 in a cardboard box 3 formed by folding and gluing a blank 4.

Packing machine 1 comprises an input conveyor 5 (shown schematically in FIG. 2) which is fed by an upstream packing machine (not shown) with a succession of spaced packages 2 (i.e. equally spaced a given distance apart), and feeds the succession of spaced packages 2 forward continuously (i.e. at constant speed). Downstream from input conveyor 5, an initial grouping unit 6 forms a number of lines 7 of successive adjacent individual packages 2. Downstream from initial grouping unit 6, a final grouping unit 8 (shown schematically in FIG. 2) superimposes a number of lines 7 of packages to form groups 9 of packages 2. And downstream from final grouping unit 8, a packing unit 10 (shown schematically in FIG. 1) packs each group 9 of packages 2 inside a respective cardboard box 3.

Figure 3:
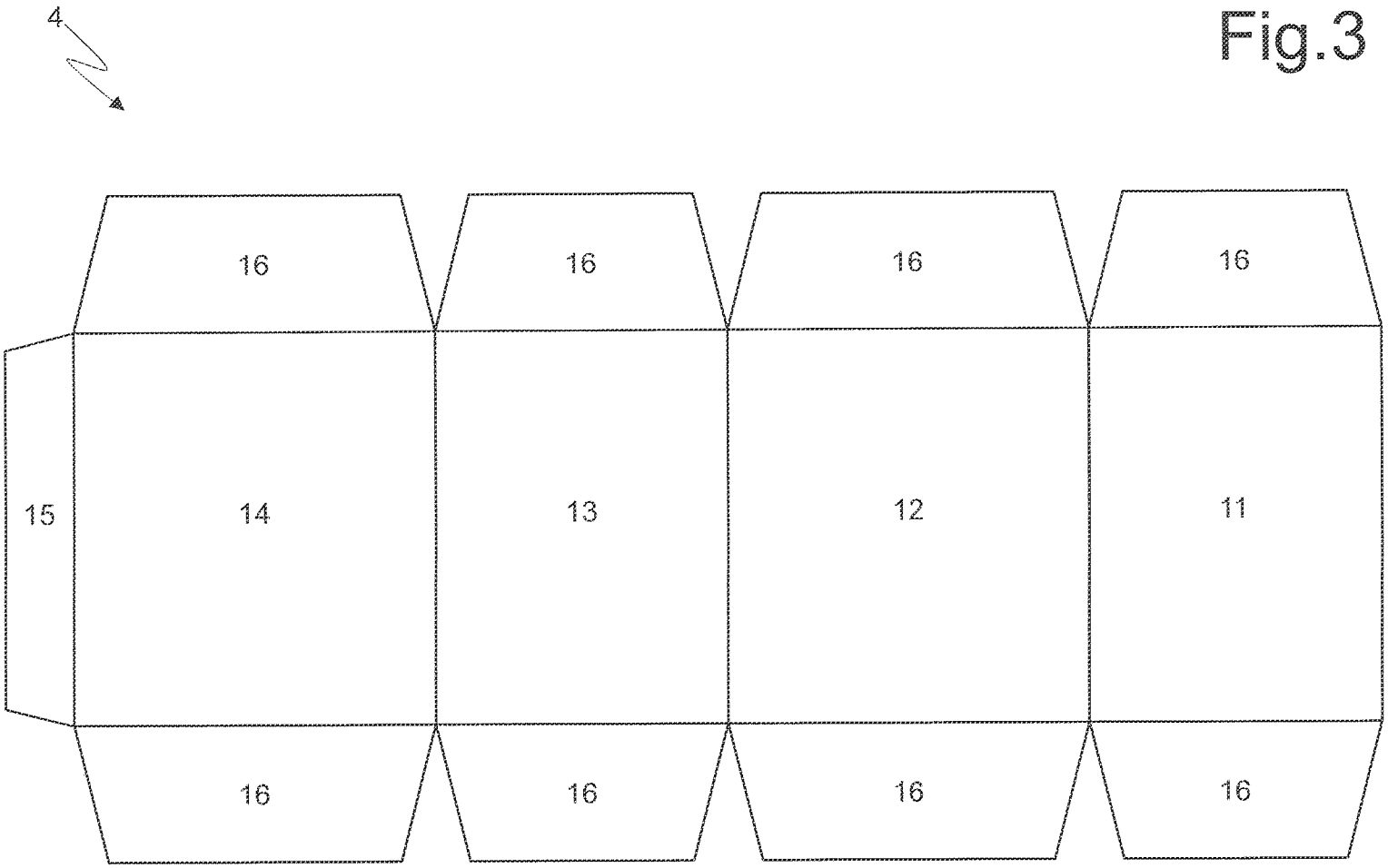
FIG. 3 shows a blank from which to form a cardboard box on the FIG. 1 packing machine.

As shown in FIG. 3, each blank 4 comprises: a panel 11 forming a lateral wall of cardboard box 3; a panel 12 forming a bottom wall of cardboard box 3; a panel 13 forming a further lateral wall of cardboard box 3; and a panel 14 forming a top wall of cardboard box 3. Panel 14 has a fastening tab 15 which is glued to the inside of panel 11 to form blank 4 into a firm tubular shape. And each of panels 11-14 comprises two wings 16 located at opposite ends of panel 11-14 to form respective parts of the end walls of cardboard box 3.

Figure 4:
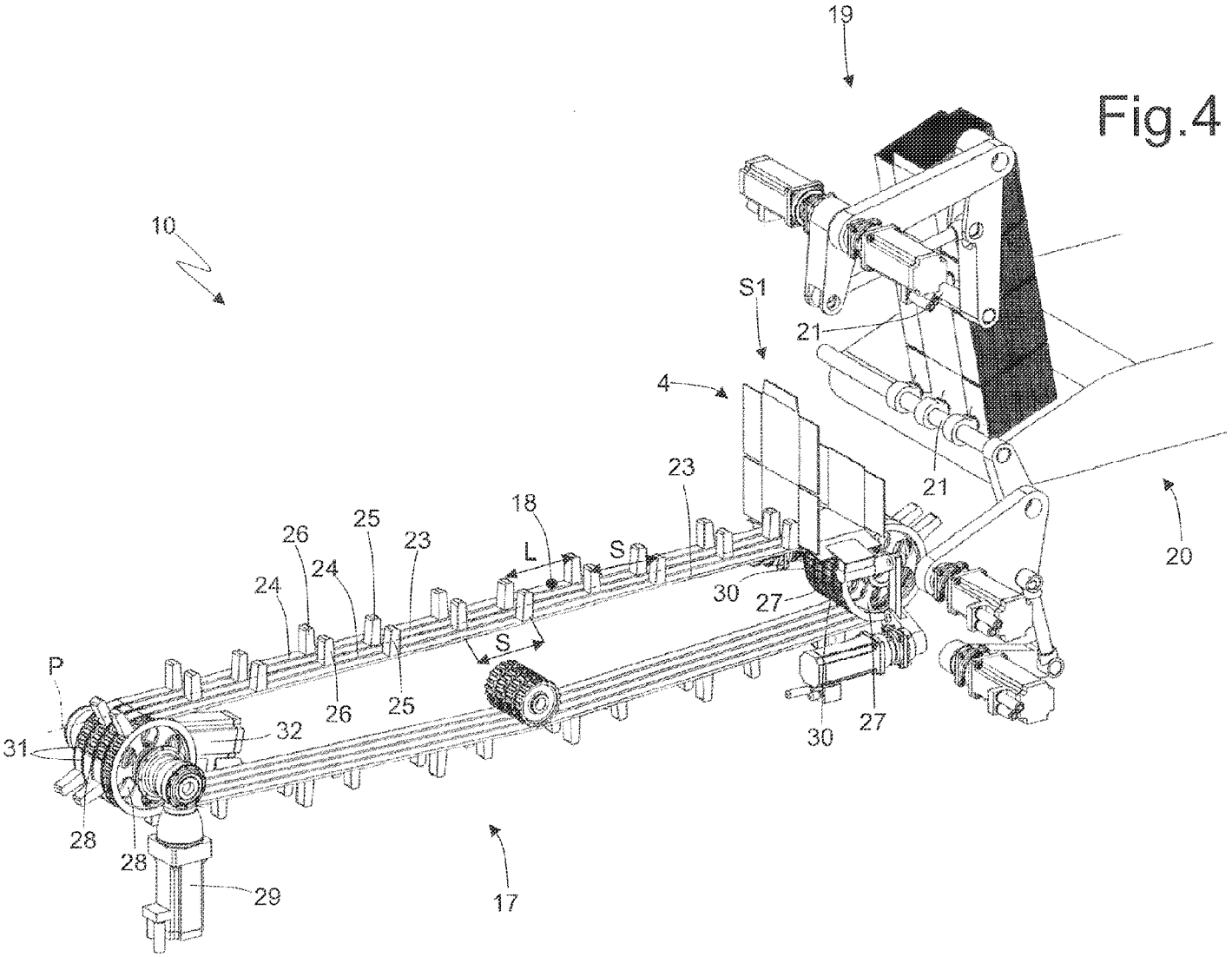
FIG. 4 shows a view in perspective, with parts removed for clarity, of a packing unit of the FIG. 1 packing machine, in accordance with the present invention.

As shown in FIG. 4, packing unit 10 comprises a packing conveyor 17 with a number of pockets 18, which are fed cyclically and intermittently in cyclically alternating stop-go steps) along a straight horizontal packing path P. As shown in FIG. 1, packing path P commences at a feed station S1 where a blank 4 is fed and folded into 'U' inside a corresponding pocket 18 on packing conveyor 17. Downstream from feed station S1, packing path P extends through a further feed station S2 where a group 9 of packages 2 is inserted longitudinally into blank 4 inside pocket 18 on packing conveyor 17. Downstream from feed station S2, packing path P extends through a packing station S3 where blank 4 is folded about group 9 of packages 2 to form cardboard box 3. And, finally, packing path P terminates at an output station S4 where cardboard box 3 is expelled longitudinally from pocket 18 on packing conveyor 17 and fed to an output of packing machine 1.

As shown in FIG. 4, packing unit 10 comprises a feed device 19 located at feed station S1 to insert blanks 4 successively inside corresponding pockets 18 on packing conveyor 17. Feed device 19 comprises a store 20 containing a stack of blanks 4; and two suction pickup heads 21 and 22, which cyclically grip the first blank 4 in the stack by suction, to extract blank 4 from store 20 and insert blank 4 inside a corresponding pocket 18 on packing conveyor 17.

Packing conveyor 17 comprises at least a first conveyor belt 23; and at least a second conveyor belt 24 separate from, parallel to, and alongside first conveyor belt 23. First and second conveyor belts 23 and 24 define a bottom wall of pocket 18.

More specifically, as shown in FIG. 4, packing conveyor 17 comprises two conveyor belts 23 extending along packing path P; and two conveyor belts 24 also extending along packing path P. The two conveyor belts 23 and two conveyor belts 24 are positioned side by side and parallel, and alternate with one another. In other words, one conveyor belt 24 is located between two conveyor belts 23 and vice versa (i.e. one conveyor belt 23 is located between two conveyor belts 24). Conveyor belts 23 and 24 together define the bottom of each pocket 18, i.e. each conveyor belt 23, 24 defines part of the bottom wall of each pocket 18. Conveyor belts 23 support a number of vertical retaining members 25, each of which projects perpendicularly (i.e. projects upwards) from the corresponding conveyor belt 23, and defines a front wall of a respective pocket 18 in the direction of packing P. And conveyor belts 24 support a number of vertical retaining members 26, each of which projects perpendicularly (i.e. projects upwards) from the corresponding conveyor belt 24, and defines a rear wall of a respective pocket 18 in the direction of packing P.

Figure 6:
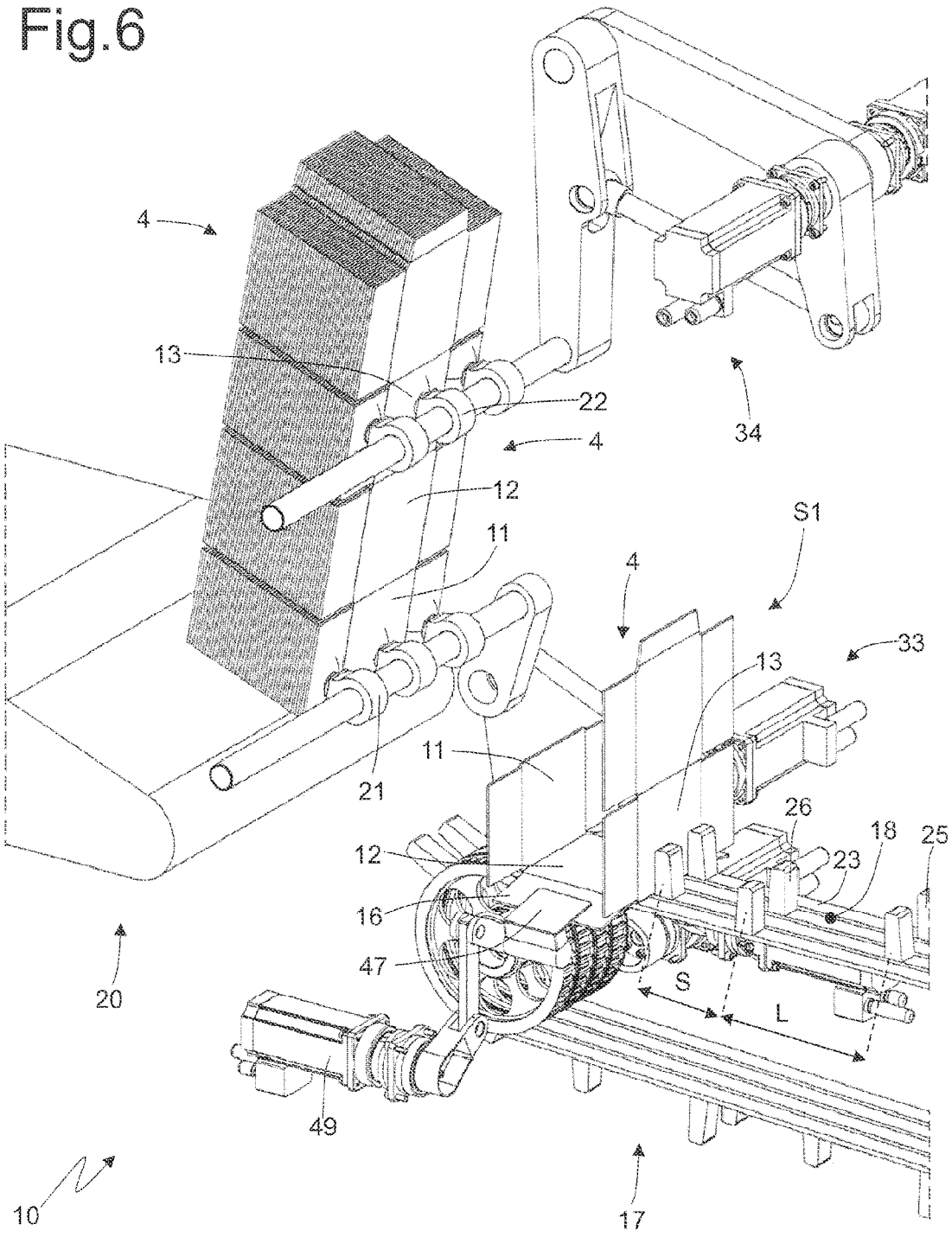
FIGS. 6-13 show eight views in perspective of part of the FIG. 4 packing unit at successive blank-folding stages.
Figure 7:
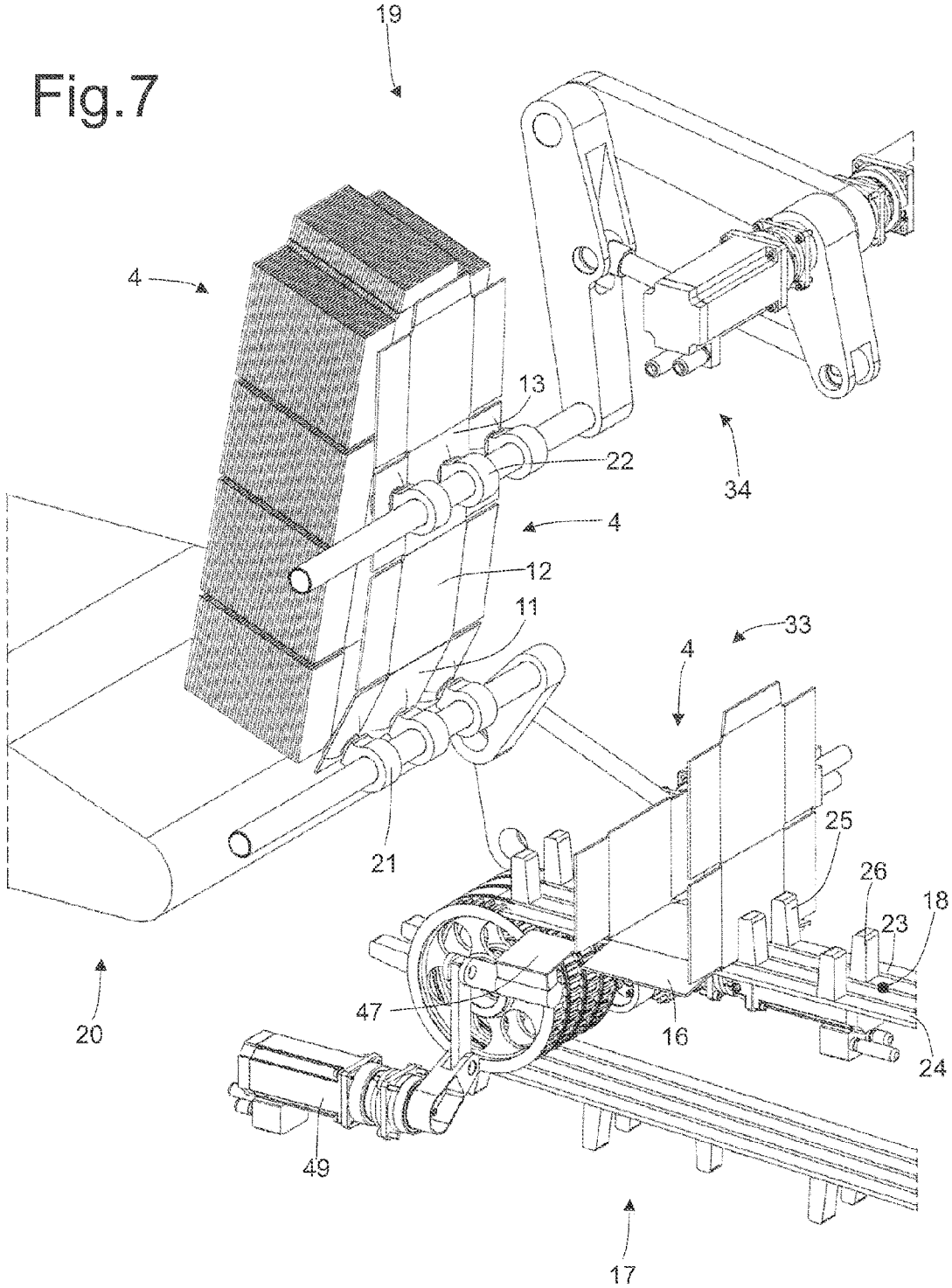
Figure 8:
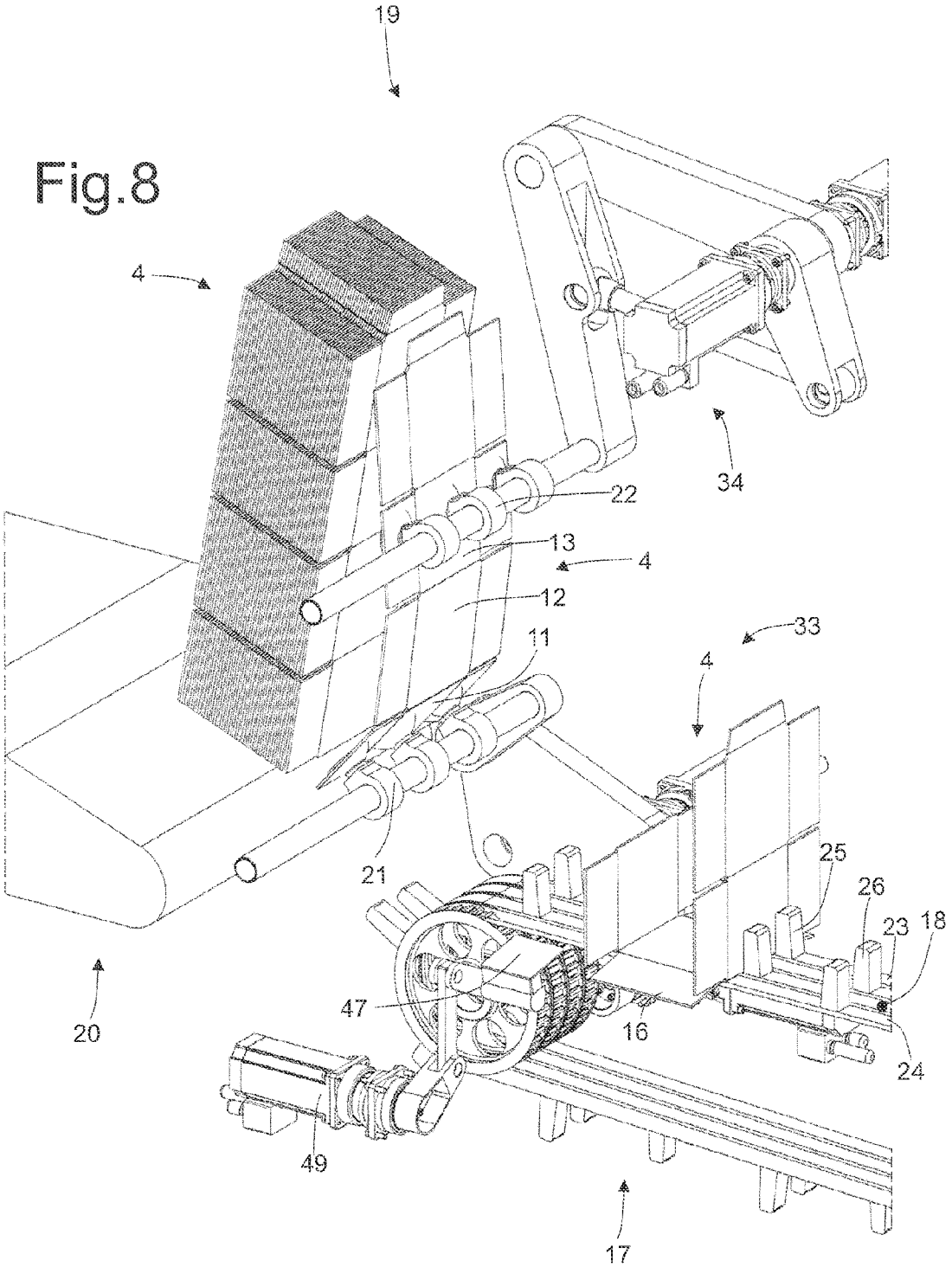
Figure 9:
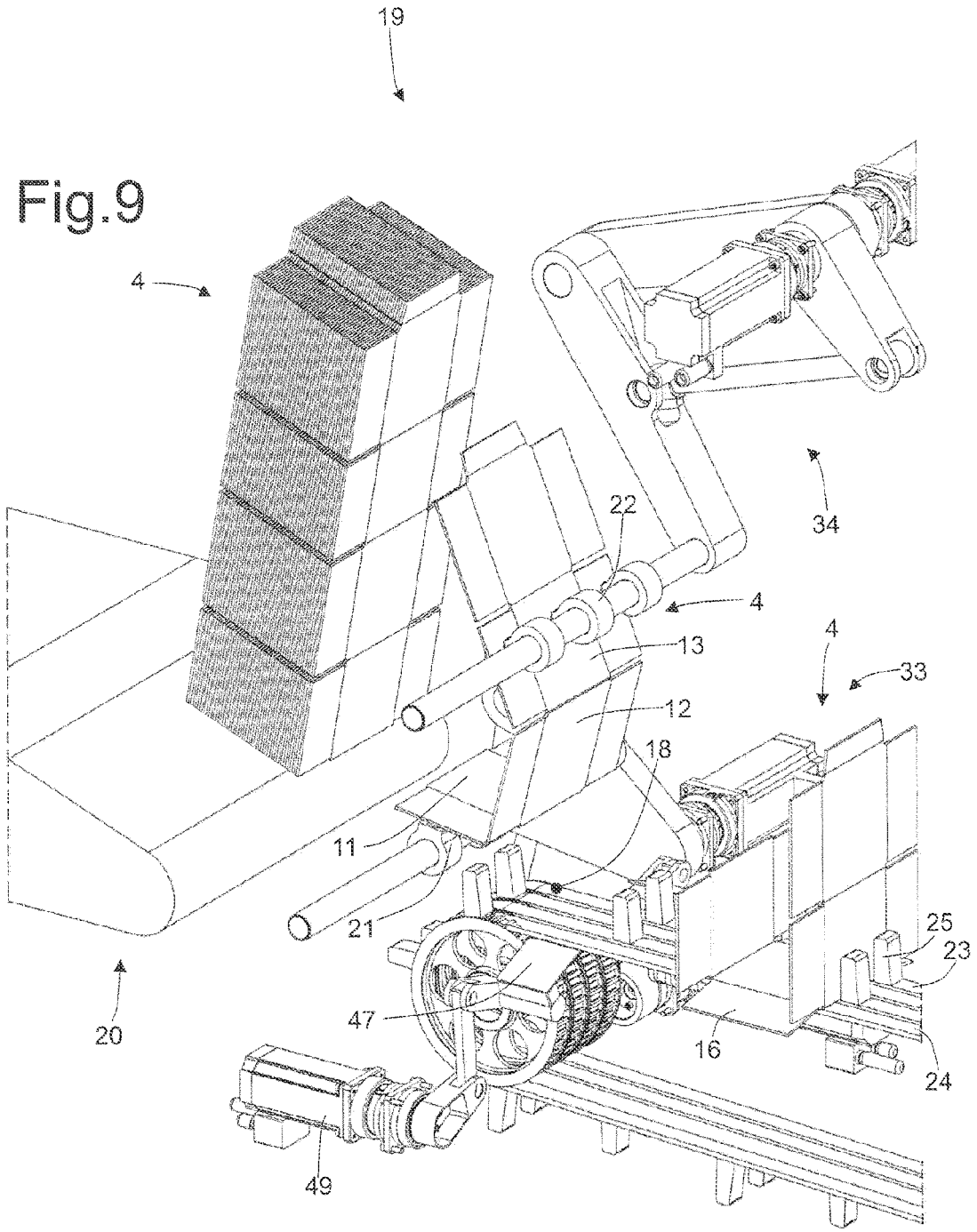

The distance between retaining member 25 and retaining member 26 in the direction of packing path P defines the length L of pocket 18, as shown by way of example in FIGS. 4 and 6.

Said length L is therefore adjustable according to the format of blank 4. And, by adjusting the length of pocket 18 on the conveyor, blanks 4 of different formats (i.e. different sizes) can be retained inside the same pocket without changing any component parts on packing unit 10.

Pockets 18 on packing conveyor 17 are arranged successively and spaced apart (i.e. a given distance is left between each pocket 18 and the two adjacent pockets 18) by a spacing distance S defined by the distance between retaining member 26 of one pocket 18 and retaining member 25 of the upstream pocket 18 in the direction of packing path P (as shown in FIGS. 4 and 6). Pockets 18 are bounded at the front by two corresponding retaining members 25 on conveyor belts 23, and at the rear by two corresponding retaining members 26 on conveyor belts 24. In other words, for each pocket 18 on packing conveyor 17, the front wall of pocket 18 is always defined by two retaining members 25 on the two side by side, spaced conveyor bets 23 (a conveyor belt 24 is interposed between the two conveyor be 23), and the rear wall of pocket 18 is always, defined by two retaining members 26 on the two side by side, spaced conveyor belts 24 (a conveyor belt 23 interposed between the two conveyor belts 24). It is important to note that each retaining member 25 only defines the front wall of a corresponding pocket 18 on packing conveyor 17, and each retaining member 26 only defines the rear wall of a corresponding pocket 18 on packing conveyor 17.

Spacing distance S therefore allows the two suction pickup heads 21, 22 to operate as described in detail below.

To adjust length L, packing conveyor 17 produces a relative movement between conveyor belt 23 and conveyor belt 24, to move retaining members 25, 26 of pocket 18 towards or away from each other according to the format (size) of blank 4.

Each conveyor belt 23 is looped about two end pulleys 27 and 28; each end pulley 27 is mounted idly (i.e. rotates freely about a central axis of rotation) while each end pulley 28 is powered, i.e. is connected mechanically to a common electric motor 29 which rotates both powered end pulleys 28 synchronously. Likewise, each conveyor belt 24 is looped about two end pulleys 30 and 31; each end pulley 30 is mounted idly (i.e. rotates freely about a central axis of rotation); while each end pulley 31 is powered, i.e. is connected mechanically to a common electric motor 32 which rotates both powered end pulleys 31 synchronously, and is separate from and independent of electric motor 29.

In actual use, end pulleys 27 and 28 of conveyor belts 23 can be operated out of phase with respect to end pulleys 30 and 31 of conveyor belts 24 to adjust the length of pockets 18 according to the format (i.e. size) of blank 4, by producing a relative movement between belt 23 and belt 24, as described previously. In other words, the timing of end pulleys 27, 28 of conveyor belts 23 and end pulleys 30, 31 of conveyor belts 24 can be adjusted to produce a relative movement between the two conveyor belts 23 and the two conveyor belts 24, and so move retaining members 25 and 26 of each pocket 18 towards or away from each other to adjust the length of pockets 18 according to the format (i.e. size) of blank 4. In actual fact, only the timing of powered end pulleys 28 and 31 (whose angular position is controlled actively by electric motors 29 and 32) is actively adjusted, and the timing of idle end pulleys 27 and 30 adapts passively to that of powered end pulleys 28 and 31. Obviously, the timing of powered end pulleys 28 and 31 is only actively adjusted when packing machine 1 is off and empty, i.e. during a format changeover to adapt packing machine 1 to cardboard boxes 3 (and therefore blanks 4) a different format (i.e. size). More specifically, when working with wider or narrower panels 12 of blanks 4, the length of each pocket 18 is adjusted to always equal the width of panels 12 of blanks 4 (obviously, allowing for the necessary tolerances).

In the FIG. 4 embodiment, powered end pulleys 28 and 31 are driven by two separate independent electric motors 29 and 32; so, the timing of powered end pulleys 28 and 31 can be adjusted by simply software adjusting (i.e. with no physical work involved) the law of motion of at least one of electric motors and 32. An alternative embodiment, not shown, only has electric motor 32, which drives both powered end pulleys 28 and 31; so powered end pulleys 28 and 31 can be operated mechanically out of phase with respect to the drive shaft of electric motor 32 to adjust the length of pockets 18 according to the format of blank 4. In other words, the timing between powered end pulleys 28, 31 and the drive shaft of electric motor 32 can be adjusted manually when packing machine 1 is off.

Feed device 19 comprises a suction pickup head 21 which engages panel 11 of blank 4 inside store 20; and a suction pickup head 22 which engages panel 13 of blank 4 in store 20. Feed device 19 also comprises actuating devices 33, 34 for moving pickup heads 21, 22 from a withdrawal position at store 20, to a release position at packing conveyor 17, to insert blank 4 into pocket 18 on packing conveyor 17, and to release blank 4, folded into a 'U', inside pocket 18.

Actuating devices 33, 34 alter the distance between pickup heads 21, 22 and the packing unit at store 20 according to the format (i.e. size) of blank 4. So, in addition to flexible pockets 18, pickup heads 21, 22 are also designed for maximum flexibility, to work with blanks of different sizes.

As the pickup heads move from the withdrawal to the release position, actuating devices 33, 34 produce a relative movement between pickup head 21 and pickup head 22 to fold blank 4 into a 'U' before it is inserted into pocket 18 on packing conveyor 17. More specifically, as the pickup heads move from the withdrawal position to the release position, operation of actuating devices 33, 34 is adjustable to adjust the movements of pickup heads 21, 22 according to the format of blank 4.

This also allows for flexiblity in folding the blank into a 'U', by allowing the same blank or different blanks to be folded into a 'U' at different portions.

Figure 5:
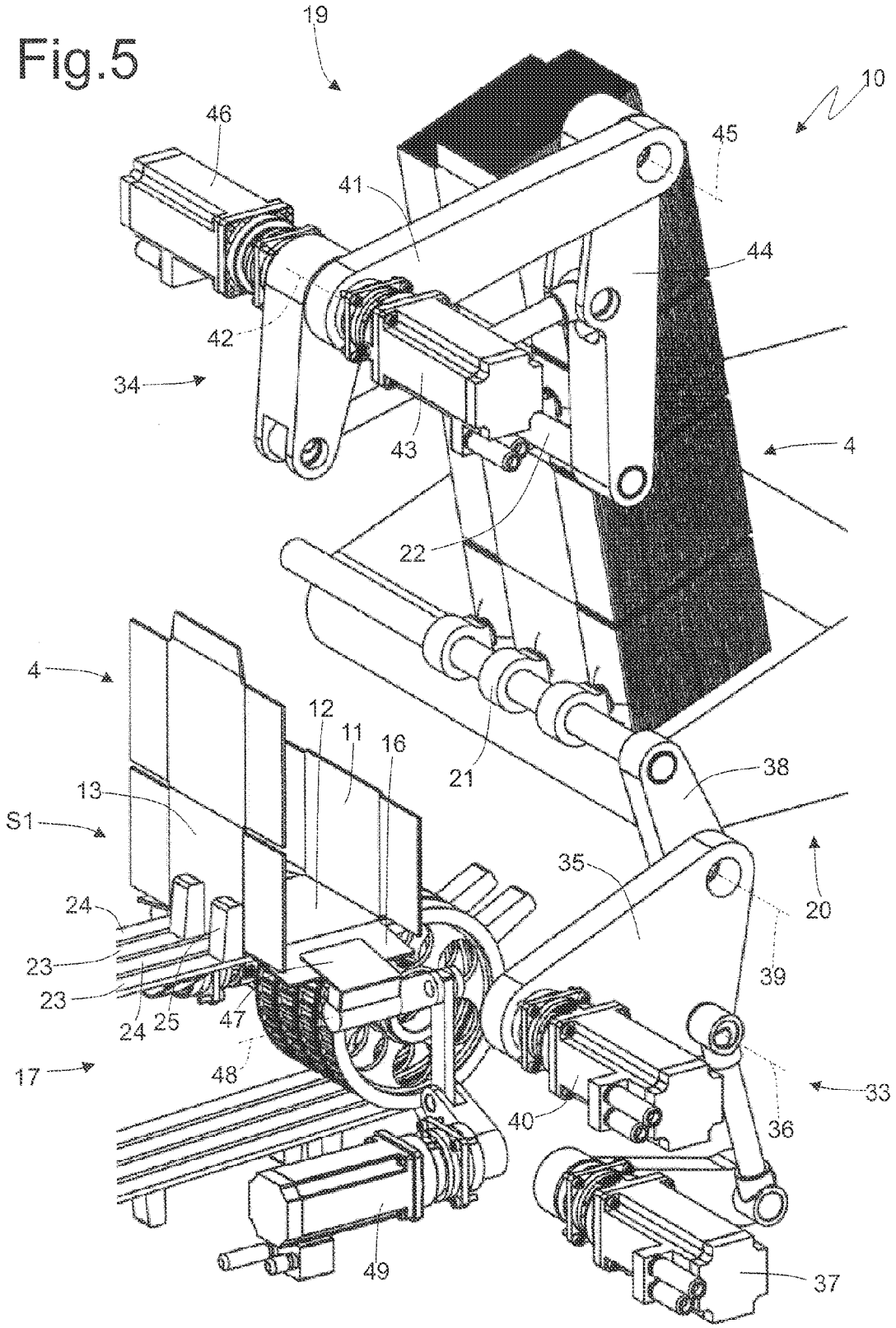
FIG. 5 shows a larger-scale detail of FIG. 4.

As shown in FIG. 5, feed device 19 comprises actuating device 33 which moves pickup head 21 with two degrees of rotational freedom to perform the movement described below; and actuating device 34 which moves pickup head 22 also with two degrees of rotational freedom to perform the movement described below.

Actuating device 33 comprises a supporting plate 35 hinged (i.e. fitted in rotary manner) to a fixed frame (not shown) of packing machine 1, and which is rotated with respect to the fixed frame about a horizontal axis of rotation 36 by an electric motor 37 offset with respect to axis of rotation 36. More specifically, the shaft of electric motor 37 is connected mechanically to supporting plate 35 by a mechanism comprising two mutually hinged arms. Supporting plate 35 is fitted with an arm hinged (i.e. fitted in rotary manner) to supporting plate 35, and which is rotated with respect to supporting plate 35 about a horizontal axis of rotation 39 (parallel to axis of rotation 36) by an electric motor 40 (also fitted to supporting plate 35 and offset with respect to axis of rotation 39). Arm 38 is hinged at one end to supporting plate 35, and at the opposite end is connected rigidly to pickup head 21. In other words, pickup head 21 is connected rigidly to one end of arm 38. So actuating device 33 can rotate pickup head 21 about both axes of rotation 36 and 39, which are spaced apart and parallel.

Actuating device 34 comprises an arm 41 hinged (i.e. fitted in rotary manner) to the fixed frame (not shown) of packing machine 1, and which is rotated with respect to the fixed frame about a horizontal axis of rotation 42 by an electric motor 43 coaxial with axis of rotation 42. Arm 41 is fitted with an arm 44 hinged (i.e. fitted in rotary manner) to arm 41, and which is rotated with respect to arm 41 about a horizontal axis of rotation 45 (parallel to axis of rotation 42) by an electric motor 46 (also fitted to arm 41 and offset with respect to axis of rotation 45). More specifically, the shaft of electric motor 46 is connected mechanically to arm 44 by a mechanism comprising two mutually hinged arms. Arm 44 is hinged at one end to arm 41, and at the opposite end is connected rigidly to pickup head 22. In other words, pickup head 22 is connected rigidly to one end of arm 44. So actuating device 34 can rotate pickup head 22 about both axes of rotation 42 and 45, which are spaced apart and parallel.

Normally, when making a format, change, i.e. changing over to blanks 4 of different sizes, the movements of the two pickup heads 21 and 22 (i.e. the laws of motion of electric motors 37, 40, 43 and 46) need simply be software adjusted (i.e. with no physical work involved). Obviously, the movements of the two pickup heads 21 and 22 are only adjusted when packing machine 1 is off and empty, i.e. during a format changeover to adapt packing machine 1 to cardboard boxes 3 (and therefore blanks 4) of a different format (i.e. size). In one possible embodiment, actuating device 33 and/or actuating device 34 may be fitted to the frame of packing machine 1 to move vertically to adjust the vertical position of pickup head 21 and/or pickup head 22 according to the format (i.e. size) of blank 4. In one possible embodiment, actuating devices 33 and 34 are translated vertically by hand (by pushing manually on the supports of actuating devices 33 and 34, or by rotating a handwheel); in a preferred embodiment, vertical translation of actuating devices 33 and 34 is controlled by electric actuators feedback-controlled by position sensors.

Figure 10:
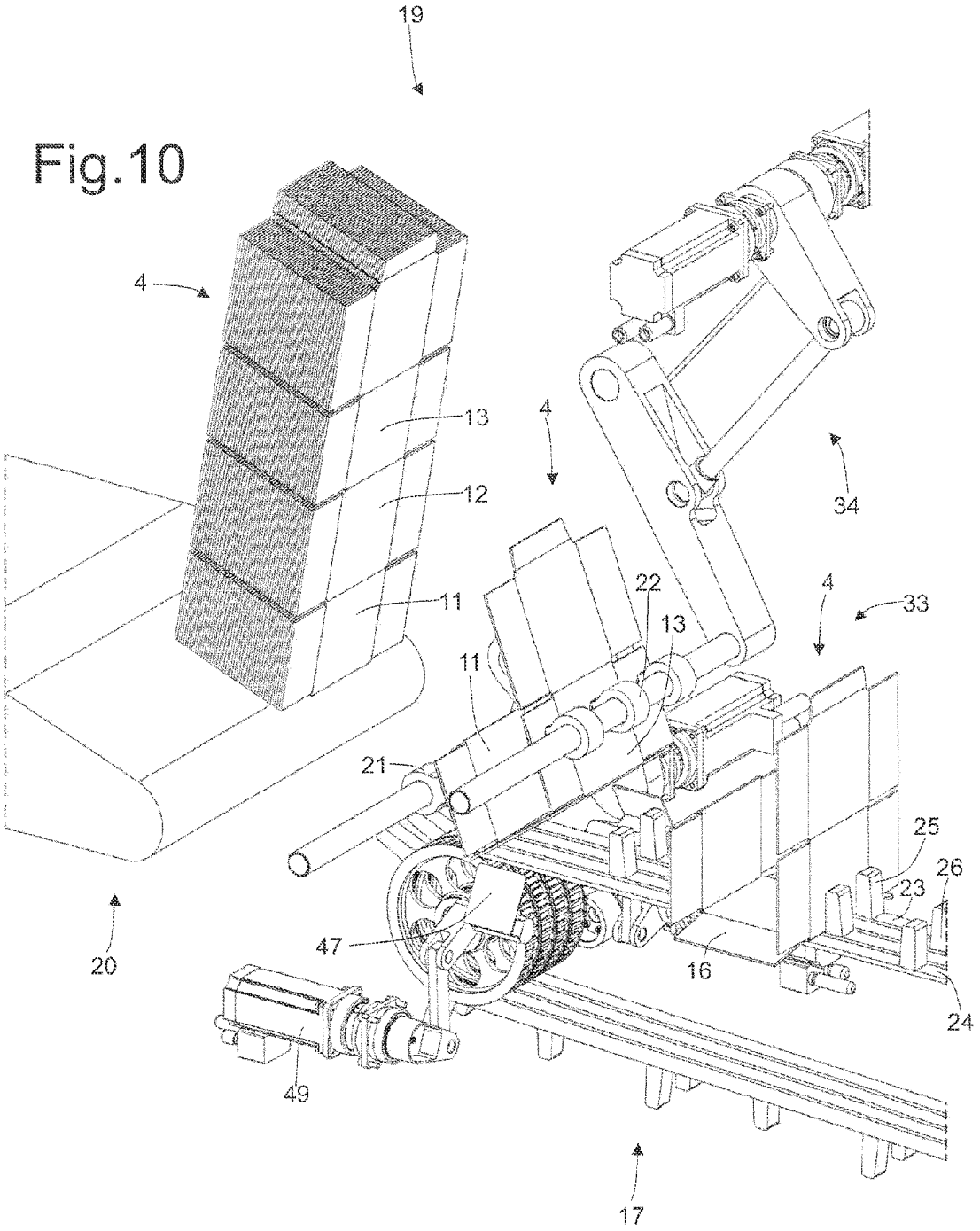

As shown in FIG. 5, at feed station S1, two movable folding devices 47 (only one shown in FIG. 5) are located on opposite sides of packing conveyor 17, and each mounted to rotate about a horizontal axis of rotation 48, parallel to packing path. P, under the control of an electric motor 49. Each movable folding device 47 is moved cyclically by electric motor 49 between an engaged or lowered position (shown, for example, in FIG. 5), in which movable folding device folds down a corresponding wing 16 of panel 12 of blank 4, and a release or raised position (shown, for example, in FIG. 10), in which movable folding device 47 is relatively distant from pocket 18 at feed station S1, so as not to obstruct insertion of blank 4 into pocket 18. Downstream from each movable folding device 47 and along packing path P (i.e. along the path of packing conveyor 17), a fixed folding device 50 (shown schematically in FIG. 13) continues the work of movable folding device 47 to keep wing 16 of panel 12 of each blank 4 folded down.

Operation of packing unit 10 to feed a blank 4 into a pocket 18 on packing conveyor 17 will now be described with reference to FIGS. 6-13.

To begin with, as shown in FIG. 6, actuating device 33 moves pickup head 21 to engage (i.e. grip and retain by suction) panel 11 of blank 4 at the outlet of store 20 (i.e. the first blank 4 in the stack in store 20); and, at the same time, actuating device 34 moves pickup head 22 to engage (i.e. grip and retain by suction) panel 13 of blank 4 at the outlet of store 20 (i.e. the first blank 4 in the stack in store 20).

Next, as shown in FIGS. 7-11, actuating devices 33 and 34 move the two pickup heads 21, 22 (holding blank 4) synchronously from a withdrawal position at the outlet of store 20 to a release position at packing conveyor 17, to insert blank 4 inside respective pocket 18 on packing conveyor 17.

Figure 12:
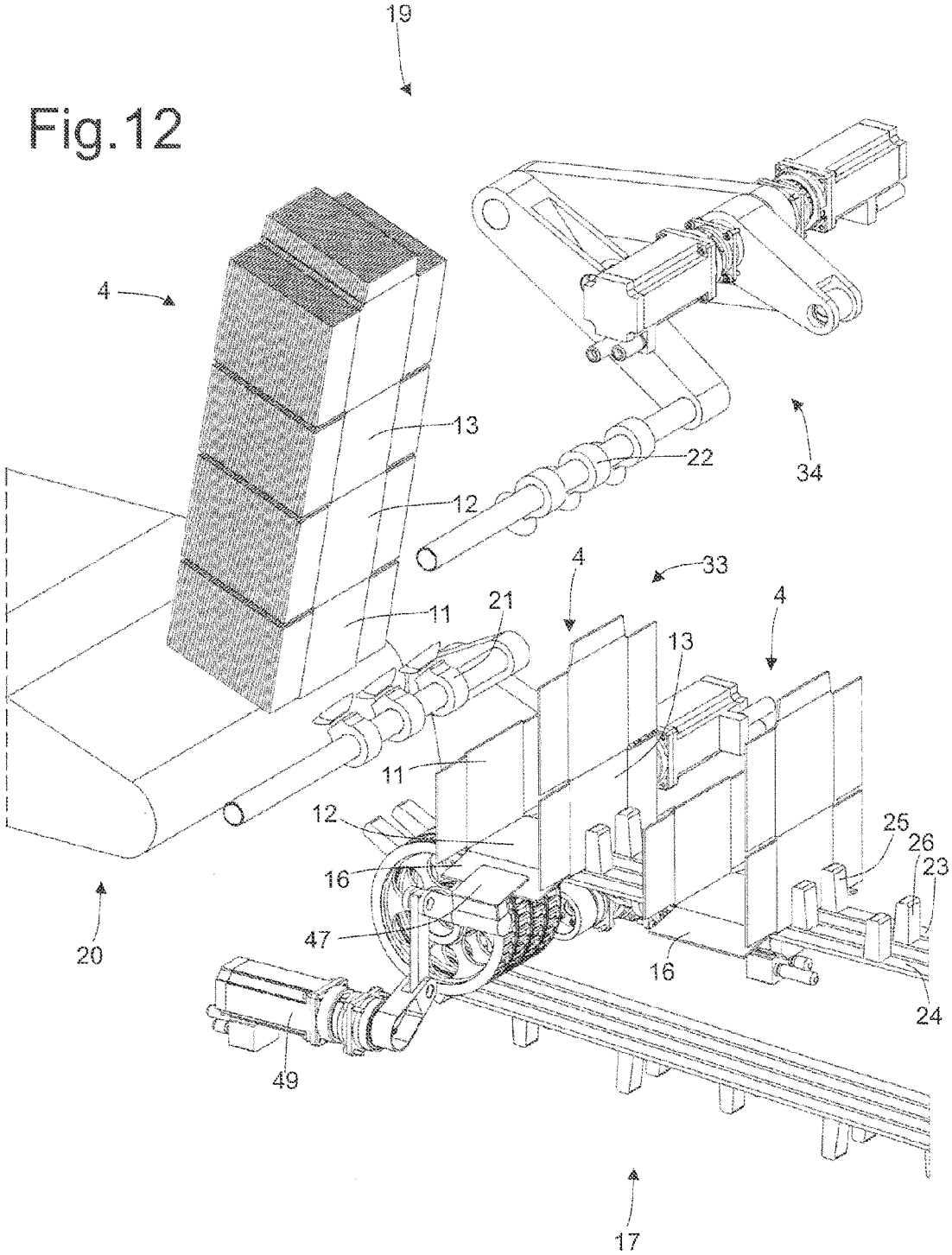
Figure 13:
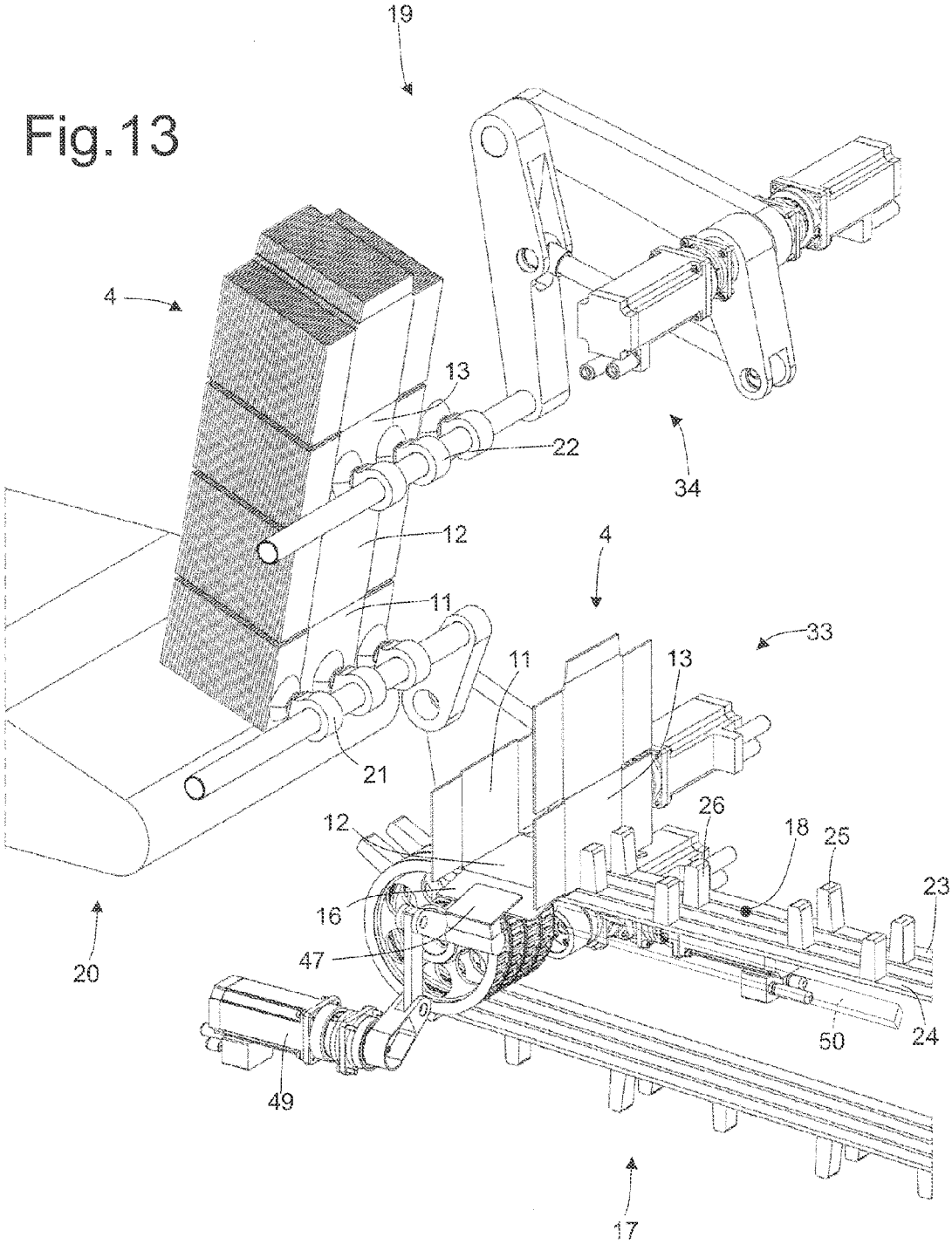

Finally, as shown in FIGS. 12 and 13, pickup heads 21, 22 (by cutting off suction) release blank 4, folded into a 'U', inside respective pocket 18 on packing conveyor 17, and move back to the withdrawal position at the outlet of store 20 to repeat the feed cycle on the next blank 4.

Figure 11:
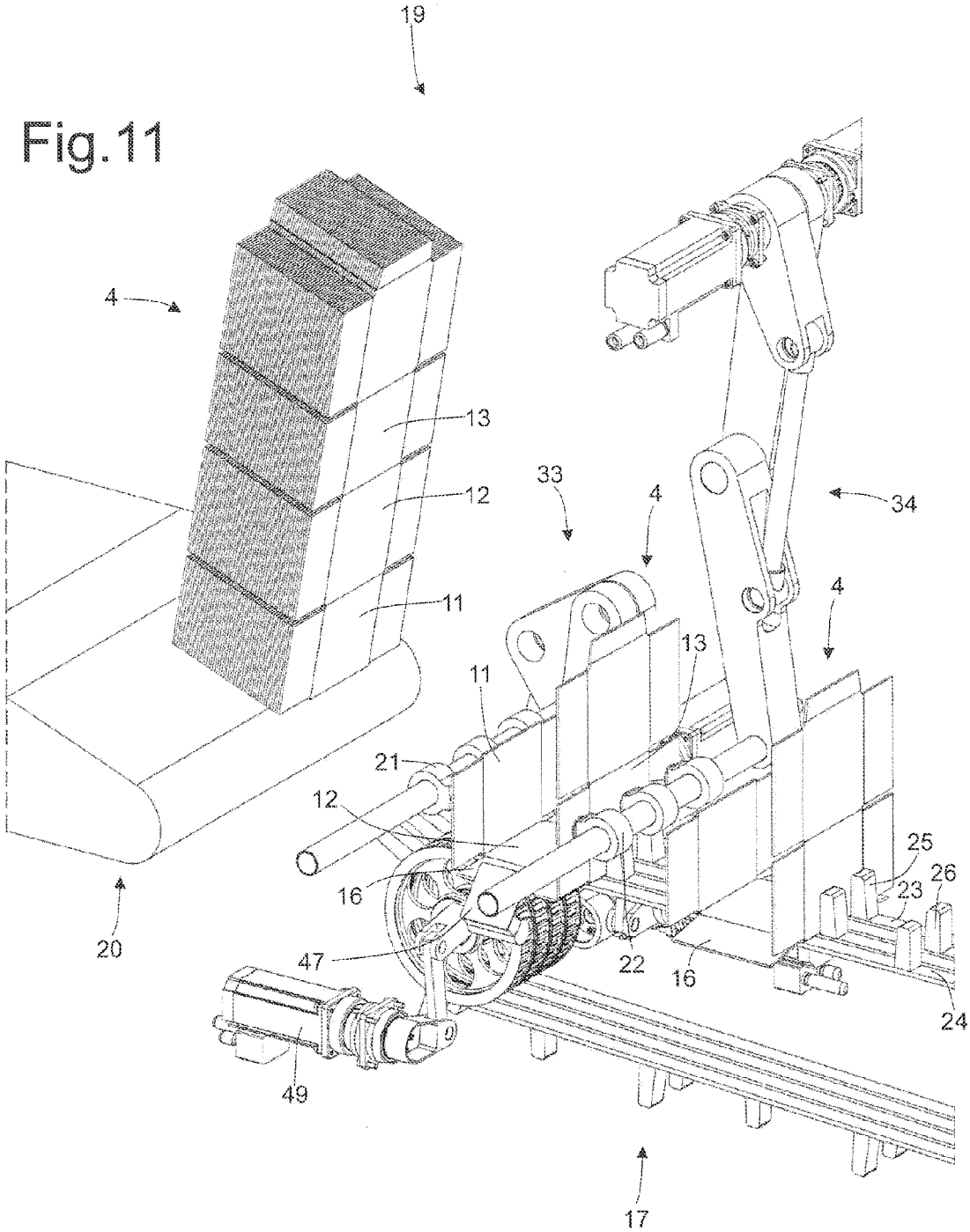

As shown in FIGS. 7-10, as the pickup heads move from the withdrawal to the release position, actuating devices 33, 34 produce a relative movement between pickup head 21 and pickup head 22 to fold blank 4 into a 'U' before it is inserted into respective pocket 18 on packing conveyor 17. In other words, pickup heads 21, 22 are initially oriented the same way at different heights (as shown in FIG. 6), and are moved with respect no each other so that they are eventually oppositely oriented and at the same height (as shown in FIG. 11). As a result, the initially flat blank 4 (FIG. 6) is folded into a 'U' (FIG. 11) by rotating panels 11 and 13 90° with respect to panel 12. It is important to note that the relative movement between pickup heads 21 and 22 comprises rotating pickup head 21 180° with respect to pickup head 22. The effect of this relative movement between pickup heads 21 and 22 is that the initially equally-oriented pickup heads 21, 22 (FIG. 6) are eventually oppositely-oriented (FIG. 11).

In a preferred embodiment, pickup heads 21 and 22 rotate panels 11 and 13 of blank 4 over 90° with respect to panel 12 before inserting the U-folded blank 4 inside pocket 18 on packing conveyor 17; next, pickup heads 21 and 22 rotate panels 11 and 13 of blank 4 the opposite way with respect to panel 12, so that panels 11 and 13 are perpendicular to panel 12 when the U-folded blank 4 is inside pocket 18 on packing conveyor 17. In other words, before inserting the U-folded blank 4 into pocket 18 on packing conveyor 17, pickup heads 21 and 22 'close' the formed by panels 11 and 13, by rotating them over 90° (e.g. 100-110°), so the U-folded blank 4 is easier to insert inside pocket 18; and, once the U-folded blank 4 is inserted inside pocket 18, pickup heads 21 and 22 'open' the 'U' formed by panels 11 and 13, so panels 11 and 13 are perfectly perpendicular (i.e. exactly 90°) to panel 12.

In a preferred embodiment, as the U-folded blank 4 is inserted inside pocket 18 on packing conveyor 17, the two movable folding devices 47 are set to the release position (shown, for example, in FIGS. 10 and 11), in which each movable folding device 47 is relatively distant from pocket 18 at feed station S1, so as not to obstruct insertion of blank 4 into pocket 18. Once the U-folded blank 4 is inserted inside pocket 18 on packing conveyor 17, the two movable folding devices 47 are moved into the engaged position (shown, for example, in FIG. 12), in which each movable folding device 47 folds down a corresponding wing 16 of panel 12 of blank 4. Movable folding devices 47 remain in the engaged position engaging wings 16 of panel 12 until the movement of packing conveyor 17 withdraws wings 16 from movable folding devices 47; and, directly downstream from movable folding devices 47, fixed folding devices 50 keep wings 16 of panel 12 in the down-folded position a packing conveyor 17 feeds blank 4 along packing path P (more specifically, through feed station S2).

Movable folding devices 47 and fixed folding devices 50 serve to fold down, and keep folded down, wings 16 of panel 12 of blank 4, so that, at feed station S2, wings 16 of panel 12 in no way impede insertion of group 9 of packages 2 into blank 4 inside pocket 18 on packing conveyor 17.

Packing unit 10 described has numerous advantages.

Firstly, packing unit 10 described is highly flexible, i.e. provides for rapidly changing the format (i.e. size) of blanks 4.

The format (i.e. size) of blanks 4 can be changed by simply appropriately altering the movements of pickup heads 21 and 22, which can be done by software adjusting (i.e. with no physical work involved) the laws of motion of electric motors 37, 40, 43, 46, without changing any actual component parts of packing unit 10. Moreover, the format (i.e. size) of blanks 4 can be changed by simply adjusting the length of pockets 18 on packing conveyor 17, by software adjusting (i.e. with no physical work involved) the law of motion of at least one of electric motors 29 and 32, without changing any actual component parts of packing unit 10. In other words, all the operations involved in changing the format (i.e. size) of blanks 4 are performed without changing any actual component parts of packing unit 10, and with no manual labour on the part of the operator.

Secondly, packing unit 10 described is also cheap and easy to produce.

Finally, packing unit 10 described enables extremely high output rates to be achieved, by treating blanks 4 'gently', i.e. not subjecting them to severe mechanical stress (i.e. sharp acceleration/deceleration).

The invention claimed is:

1. A packing unit (10) for folding a blank (4) on a packing machine (1); the packing unit (10) comprising:

a packing conveyor (17) having at least one pocket (18) for receiving the blank (4); and a feed device (19) for inserting the blank (4) into the pocket (18) on the packing conveyor (17);

wherein the packing conveyor (17) comprises: at least a first conveyor belt (23), and at least a second conveyor be (24) separate from, parallel to, and alongside the first conveyor belt (23), said first and second (24) conveyor belts forming a bottom wall of the pocket (18); a first retaining member (25), which projects perpendicularly from the first conveyor belt (23) and forms a front wall of the pocket (18) in the direction of the packing path (P); and a second retaining member (26), which projects perpendicularly from the second conveyor belt and forms a rear wall of the pocket (18) in the direction of the packing path (P); and wherein the length (L) of said pocket (18) is a distance between said first retaining member (25) and said second retaining member (26) in the direction of the packing path (P)

the packing unit (10) being characterized in that the feed device (19) comprises:

a first suction pickup head (21), which engages a first panel (11) of the blank (4) inside a store (20);

a second suction pickup head (22), which engages a second panel (13) of the blank (4) inside the store (20); and actuating devices (33, 34) for moving the pickup heads (21, 22) from a withdrawal position at the store (20) to a release position at the packing conveyor (17), to insert the blank (4) inside the pocket (18) on the packing conveyor (17), and then release the blank (4), folded into a 'U', inside the pocket (18) on the packing conveyor (17);

wherein said length (L) is variable according to the format of said blank (4); and wherein said actuating devices (33, 34) alters the distance between said pickup heads (21, 22) and said packing unit at said store (20) according to the format of said blank (4).

2. A packing unit (10) as claimed in claim 1, wherein said packing conveyor (17) produces a relative movement between said first (23) and second (24) conveyor belts, to move said retaining members (25, 26) of said pocket (18) towards or away from each other according to the format of said blank (4).

3. A packing unit (10) as claimed in claim 1, wherein the packing conveyor (17) comprises a number of successive pockets (18), each bounded at the front by a corresponding first retaining member (25), and at the rear by a corresponding second retaining member (26); each first retaining member (25) only forms the front wall of a corresponding pocket (18); and each second retaining member (26) only defines the rear wall of a corresponding pocket (18); and said pockets (18) being spaced apart by a spacing distance (S) defined by the distance between said second retaining member (26) of a pocket (18) and said first retaining member (25) of the upstream pocket (18) in the direction of the packing path (P).

4. A packing unit (10) as claimed in claim 1, wherein the packing conveyor (17) comprises:

two first conveyor belts (23) having respective first retaining members (25); and two second conveyor belts (24) having respective second retaining members (26) and alternating with the first conveyor belts (23).

5. A packing unit (10) as claimed in claim 4, wherein said two first conveyor belts (23) and said two second conveyor belts (24) are positioned side by side and parallel, and alternate with one another.

6. A packing unit (10) as claimed in claim 1, wherein:

the first conveyor belt (23) is looped about respective first end pulleys (27, 28);

the second conveyor belt is looped about respective second end pulleys (30, 31) parallel to and alongside the first end pulleys (27, 28); and the first end pulleys (27, 28) can be operated out of phase with respect to the second end pulleys (30, 31) to adjust said length (L) of said pocket (18) according to the format of the blank (4).

7. A packing unit (10) as claimed in claim 6, wherein the packing conveyor (17) comprises:

a first motor (29), which rotates a powered first end pulley (28); and a second motor (32), which is separate from and independent of the first motor (29), and rotates a powered second end pulley (31).

8. A packing unit (10) as claimed in claim 6, wherein the packing conveyor (17) comprises one motor (32), which rotates both a powered first end pulley (28) and a powered second end pulley (31).

9. A packing unit (10) as claimed in claim 8, wherein at least one powered end pulley (28; 31) can be operated mechanically out of phase with respect to the drive shaft of the motor (32) to adjust said length (L) of the pocket (18) according to the format of the blank (4).

10. A packing unit (10) as claimed in claim 1, wherein, as the pickup heads are moved from the withdrawal position to the release position, the actuating devices (33, 34) produce a relative movement between the first pickup head (21) and the second pickup head (22) to fold the blank (4) into a 'U' before the blank (4) is inserted into the pocket (18) on the packing conveyor (17); and as said pickup heads move from the withdrawal position to the release position, operation of said actuating devices (33, 34) is adjustable to adjust the movements of said pickup heads (21, 22) according co the format of said blank (4).

* * * * *